US010976048B2

(12) United States Patent
Akbarimonfared et al.

(10) Patent No.: US 10,976,048 B2
(45) Date of Patent: Apr. 13, 2021

(54) DIFFUSER PLATE FOR PREMIXED BURNER BOX

(71) Applicant: Rheem Manufacturing Company, Atlanta, GA (US)

(72) Inventors: Amin Akbarimonfared, Fort Smith, AR (US); Timothy J. Shellenberger, Tyrone, GA (US); Robert Steven Neihouse, Fort Smith, AR (US); Scott Alan Willbanks, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 343 days.

(21) Appl. No.: 15/935,974

(22) Filed: Mar. 26, 2018

(65) Prior Publication Data

US 2018/0216817 A1 Aug. 2, 2018

Related U.S. Application Data

(63) Continuation of application No. 14/337,625, filed on Jul. 22, 2014, now Pat. No. 9,951,945.

(60) Provisional application No. 61/883,031, filed on Sep. 26, 2013.

(51) Int. Cl.

| | |
|---|---|
| ***F23D 14/70*** | (2006.01) |
| ***F23D 14/08*** | (2006.01) |
| ***F24H 9/00*** | (2006.01) |

(52) U.S. Cl.

CPC ..... *F23D 14/70* (2013.01); *F23D 14/08* (2013.01); *F24H 9/0052* (2013.01)

(58) Field of Classification Search

CPC .... F24H 9/0052; F24H 9/0063; F24H 9/0068; F23D 14/84; F23D 14/08; F23D 14/70; F23C 5/08

USPC ..... 432/29; 126/116 R; 431/354, 171

See application file for complete search history.

(56) References Cited

U.S. PATENT DOCUMENTS

| | | | |
|---|---|---|---|
| 3,181,646 | A | 5/1965 | Edwards |
| 3,701,481 | A | 10/1972 | Reichmann et al. |
| 3,888,018 | A | 6/1975 | Gaski, Jr. |
| 4,762,530 | A | 8/1988 | Koziol |
| 4,773,384 | A | 9/1988 | Koziol |
| 4,805,587 | A | 2/1989 | Schweitzer |

(Continued)

FOREIGN PATENT DOCUMENTS

| | | |
|---|---|---|
| JP | 3284518 | 5/2002 |

OTHER PUBLICATIONS

European Search Report dated Sep. 30, 2019 for EP 19171776.

(Continued)

*Primary Examiner* — Steven S Anderson, II

(74) *Attorney, Agent, or Firm* — Troutman Pepper Hamilton Sanders LLP

(57) ABSTRACT

To substantially reduce inequality in hot combustion flow rates through first and second heat exchanger tubes from a fuel-fired heating appliance burner box connected thereto and internally combusting a fuel/air mixture received therein from a source thereof to create the hot combustion gas, a perforated diffuser member having a non-uniform perforation pattern is provided. The fuel/air mixture is flowed through the perforated diffuser member into the interior of the burner box. The non-uniform perforation pattern of the diffuser member functions to alter relative combustion gas flow rates through the first and second heat exchanger tubes in a manner reducing an undesirable operating temperature differential therebetween.

11 Claims, 2 Drawing Sheets

(56) References Cited

U.S. PATENT DOCUMENTS

| | | | |
|---|---|---|---|
| 5,127,824 | A | 7/1992 | Barker |
| 5,198,625 | A | 3/1993 | Alexander |
| 5,240,411 | A | 8/1993 | Abalos |
| 5,291,875 | A | 3/1994 | Koziol |
| 5,460,512 | A | 10/1995 | Lifshits et al. |
| 5,546,925 | A | 8/1996 | Knight et al. |
| 5,791,137 | A | 8/1998 | Evans et al. |
| 6,022,213 | A | 2/2000 | Harthun |
| 2002/0166553 | A1 | 11/2002 | Topp |
| 2004/0121697 | A1 | 6/2004 | Kojima |
| 2004/0250810 | A1 | 12/2004 | Schultz et al. |
| 2005/0106517 | A1 | 5/2005 | Okada et al. |
| 2011/0104622 | A1 | 5/2011 | Sherrow |
| 2011/0220847 | A1 | 9/2011 | Hendershot et al. |
| 2013/0213379 | A1 | 8/2013 | Schultz et al. |
| 2014/0202443 | A1 | 7/2014 | Sherrow et al. |
| 2015/0086934 | A1 | 3/2015 | Akbarimonfared |

OTHER PUBLICATIONS

US Office Action dated Jul. 28, 2016, issued in U.S. Appl. No. 14/084,095; 14pgs.

International Search Report and Written Opinion issued for PCT/US2014/055381 dated Dec. 16, 2014.

DIFFUSER PLATE FOR PREMIXED BURNER BOX

CROSS-REFERENCE TO RELATED APPLICATION

The present application is a continuation application of and claims priority to U.S. patent application Ser. No. 14/337,625 filed Jul. 22, 2014, which claims the benefit of the filing date of provisional U.S. patent application No. 61/883,031 filed Sep. 26, 2013. The entire disclosure of each of the foregoing applications is hereby incorporated herein by this reference.

BACKGROUND OF THE INVENTION

The present invention relates generally to diffuser plate apparatus that functions to beneficially lessen undesirable uneven heating of combustion product-receiving heat exchanger tubes in an array thereof during the firing of a fuel-fired heating appliance, such as a furnace, with which the tubes are operatively associated.

In fuel-fired heating appliances, such as furnaces, a known firing method is to flow a fuel/air mixture into a burner box structure in which a suitable ignition device is disposed to combust the fuel air mixture and thereby create hot combustion gases used to heat air for delivery to a conditioned space. The hot combustion gases are flowed through a series of heat exchanger tubes, externally across which the air to be heated is flowed, and then discharged from the heating appliance into a suitable flue structure.

Due to various configurational characteristics of the heating appliance, during firing of the appliance undesirable uneven heating of the combustion product-receiving heat exchanger tubes may occur such that an undesirable non-uniform temperature distribution is present in the overall heat exchanger tube array. It is to this problem that the present invention is primarily directed.

DETAILED DESCRIPTION

Figure 1:
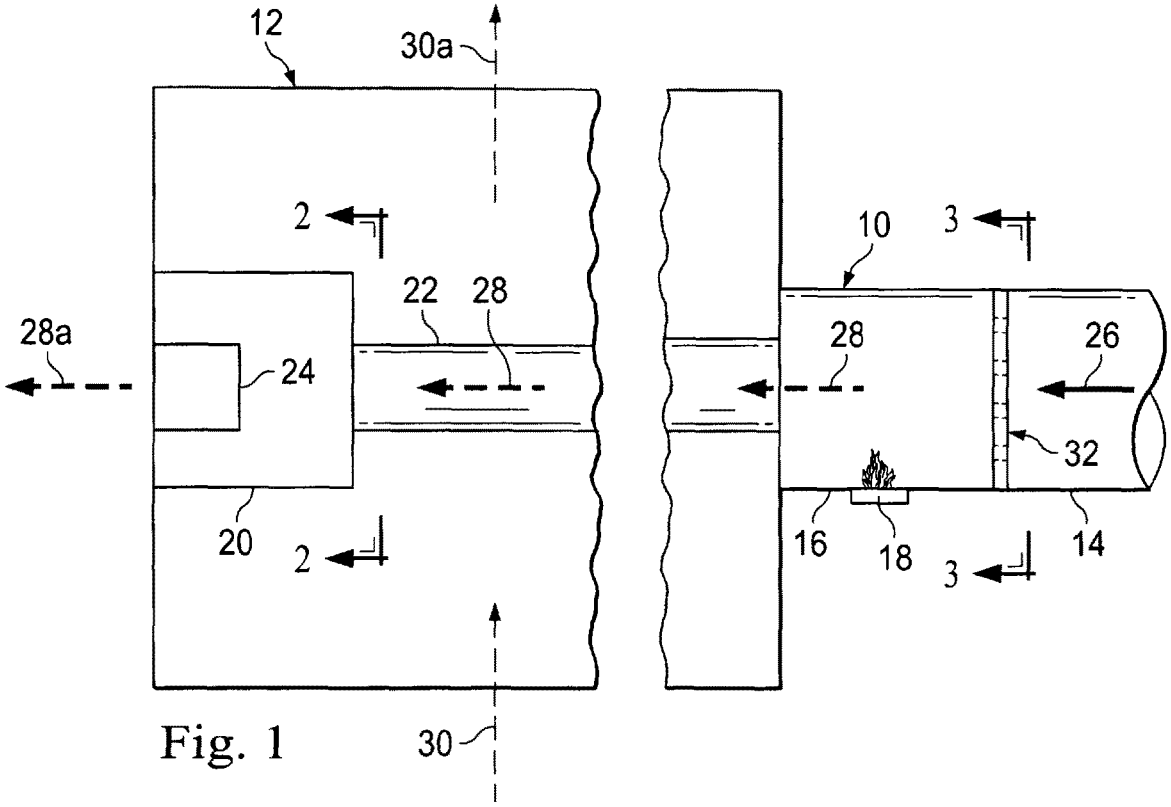
FIG. 1 is a schematic diagram of a representative fuel fired heating appliance in which the diffuser plate is incorporated.
Figure 2:
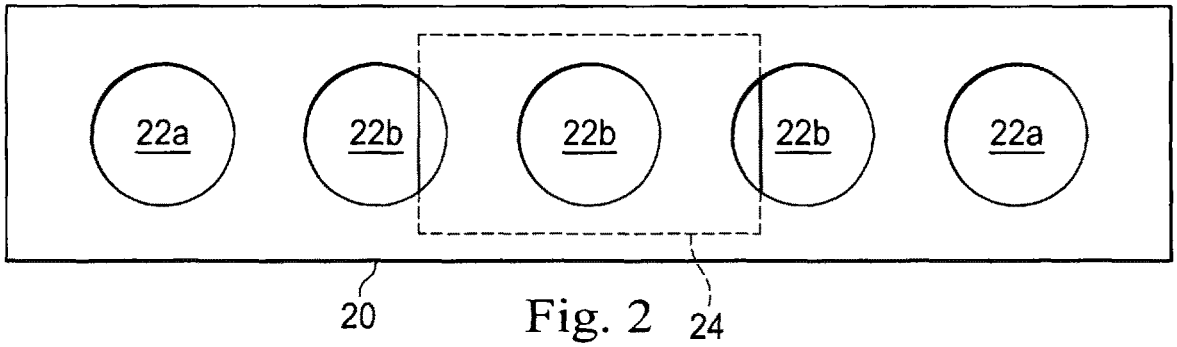
FIG. 2 is an enlarged scale schematic cross-sectional view through the heating appliance taken along line 2-2 of FIG. 1.
Figure 3:
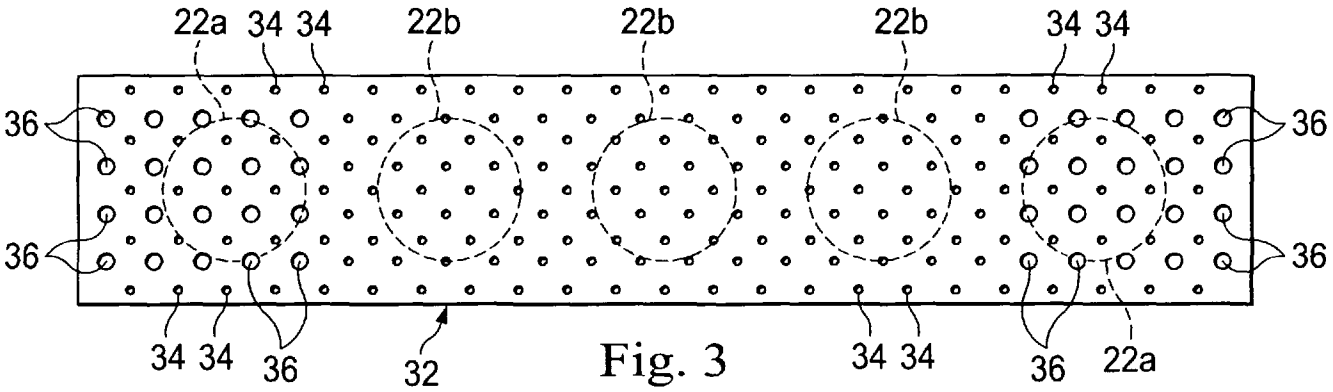
FIG. 3 is an enlarged scale schematic side elevational view of the diffuser plate taken along line 3-3 of FIG. 1.

The fuel/air combustion system 10 of a fuel-fired heating appliance, representatively a furnace 12, is schematically depicted in FIG. 1. The combustion system 10 includes a fuel/air mixture supply housing 14 (representatively a low NOx mixing box structure) that is connected to a burner box or housing 16 with which a suitable ignition device 18 is operatively associated. Burner box 16, in turn, is coupled to a collector box 20 by a series of heat exchanger tubes 22 (representatively five in number) that extend through the furnace 12 and include (as shown in FIGS. 2 and 3) two outer end tubes 22*a* and three centrally disposed tubes 22*b*. A draft inducer fan 24 is positioned within the collector box 20.

During firing of the furnace 12, the draft inducer fan 24 draws a fuel/air mixture 26 (created in a suitable manner from separate air and fuel sources not shown herein) sequentially through the fuel/air mixture supply housing 14 and into the burner box 16. Within the burner box 16 the fuel/air mixture 26 is combusted by the ignition device 18 to form hot combustion gases 28 which are drawn by the draft inducer fan 24 through the heat exchanger tubes 22 and into the collector box 20. At the same time, air 30 to be heated is suitably flowed across the heat exchanger tubes 22, to receive combustion gas heat therefrom, and is then discharged from the furnace 12 as heated air 30*a* for delivery to a conditioned space served by the furnace 12. Cooled by the heat transfer from the tubes 22 to the air 30, cooled combustion gases 28*a* are drawn into the collector box 20 by the draft inducer fan 24 and then discharged from the furnace 12 to a suitable flue (not shown).

Representatively, as shown in FIG. 2, the draft inducer fan 24 is generally centered in a left-to-right direction within the collector box 20 and with respect to the five illustratively depicted heat exchanger tubes 22. Accordingly, the suction of the fan 24 is similarly centered relative to the array of heat exchanger tubes 22. Without the incorporation in the furnace 12 of a subsequently described feature of the present invention, the result is that the per-tube flow of hot combustion gases 28 is greater for the central tubes 22*b* than it is for the end tubes 22*a*. In turn, this creates an undesirable non-uniform temperature distribution across the heat exchanger tube array, with the central tubes 22*b* having higher operating temperatures than those of the end tubes 22*a*.

With reference now to FIGS. 1 and 3, according to an aspect of the present invention, a specially designed perforated diffuser plate 32 is installed at the juncture between the fuel/air mixture supply housing 14 and the burner box 16. As shown in FIG. 3, the diffuser plate 32 illustratively has an elongated rectangular shape, and may be substantially aligned with the open inlet ends of the heat exchanger tubes 22. Along substantially the entire length of the diffuser plate 32 are formed a series of relatively small perforations 34, with relatively larger perforations 36 being additionally formed through the opposite end portions of the diffuser plate 32. This perforation pattern, as can be seen, provides opposite end portions of the diffuser plate 32 (which are generally aligned with the inlets of the end heat exchanger tubes 22*a*) with greater fuel/air mixture through-flow areas than the diffuser plate fuel/air mixture through-flow areas aligned with the inlets of the central heat exchanger tubes 22*b*.

Accordingly, during firing of the furnace 12, the presence of the diffuser plate 32 lessens the flow of hot combustion gases 28 through the central heat exchanger tubes 22*b* and increases the flow of hot combustion gases 28 through the end heat exchanger tubes 22*a*, with the hole pattern in the diffuser plate 32 being designed to substantially alleviate non-uniform temperature distribution across the heat exchanger tube array. As can be readily be seen, principles of the present invention provide a simple and quite inexpensive solution to the problem non-uniform temperature distribution across the heat exchanger tube array. Additionally, in developing the present invention it has been discovered that the use of the diffuser plate 32 also provides for improved mixing of the fuel/air mixture 26 entering the burner box 16 and further provides for a beneficial reduction in the NOx level of the discharged combustion gases 28*a*.

While a particular hole pattern in the diffuser plate has been representatively described herein, it will be readily appreciated by those of ordinary skill in this particular art that a variety of alternative hole patterns and sizes may alternatively be utilized if desired. For example, while a combination of different size holes has been representatively illustrated and described, the holes could be of uniform size but with more holes/area being disposed on the opposite ends of the diffuser plate 32 than in the longitudinally intermediate portion of the diffuser plate 32. Further, the hole pattern could be a non-uniformly spaced pattern to suit the particular application.

While principles of the present invention have been representatively illustrated and described herein as being incorporated in a fuel-fired air heating furnace, a combustion system utilizing such invention principles could alternatively be incorporated to advantage in the combustion systems of a wide variety of other types of fuel-fired heating appliances using fire tube-type heat exchangers to heat either a gas or a liquid.

The foregoing detailed description is to be clearly understood as being given by way of illustration and example only, the spirit and scope of the present invention being limited solely by the appended claims.

The invention claimed is:

1. A fuel-fired heating appliance having a combustion system comprising:

a housing having an interior and a wall portion;

first heat exchanger tubes and second heat exchanger tubes having inlets communicating with the interior of the housing through the wall portion of the housing for receiving hot combustion gas that is generated within the interior of the housing from combustion of a fuel/air mixture entering the interior of the housing, wherein the hot combustion gas is drawn from the interior of the housing through the first heat exchanger tubes and the second heat exchanger tubes by a fan that is positioned and operable such that a first flow of the hot combustion gas through the first heat exchanger tubes is greater than a second flow of the hot combustion gas through the second heat exchanger tubes thereby creating a non-uniform temperature distribution between the first heat exchanger tubes and the second heat exchanger tubes; and a diffuser plate adjacent to the housing and through which the fuel/air mixture may enter the interior of the housing, the diffuser plate comprising:

a first portion aligned with inlets of the first heat exchanger tubes and comprising a first plurality of perforations, the first plurality of perforations having a first flow area; and a second portion aligned with inlets of the second heat exchanger tubes and comprising a second plurality of perforations, the second plurality of perforations having a second flow area, wherein the second flow area is greater than the first flow area, and wherein the first plurality of perforations are configured to decrease the first flow of the hot combustion gases through the first heat exchanger tubes and the second plurality of perforations are configured to increase the second flow of the hot combustion gases through the second heat exchanger tubes such that the non-uniform temperature distribution between the first heat exchanger tubes and the second heat exchanger tubes is reduced in comparison to the non-uniform temperature distribution between the first heat exchanger tubes and the second heat exchanger tubes without the diffuser plate.

2. The fuel-fired heating appliance of claim 1 wherein the fuel fired heating appliance is an air heating furnace.

3. A fuel-fired heating appliance having a combustion system comprising:

a first heat exchanger tube and a second heat exchanger tube, each of the first and second heat exchanger tubes having an inlet configured to receive hot combustion gas from combustion of a fuel/air mixture;

a fan configured to draw the hot combustion gas through the first and second heat exchanger tubes; and a diffuser plate located upstream of the first and second heat exchanger tubes, the diffuser plate comprising:

a first portion configured to generally align with the inlet of the first heat exchanger tube and comprising a first plurality of apertures comprising a first flow area; and a second portion configured to generally align with the inlet of the second heat exchanger tube and comprising a second plurality of apertures comprising a second flow area;

wherein the second flow area is greater than the first flow area, and wherein, when the diffuser plate is installed, the first plurality of apertures are configured to decrease a first flow of the hot combustion gas through the first heat exchanger tube and the second plurality of apertures are configured to increase a second flow of the hot combustion gas through the second heat exchanger tube in comparison to the first flow and the second flow when the diffuser plate is not installed.

4. The fuel-fired heating appliance of claim 3, wherein the fuel-fired heating appliance is an air heating furnace.

5. The fuel-fired heating appliance of claim 3, wherein the diffuser plate comprises a number of the plurality of first apertures that is greater than a number of the plurality of second apertures.

6. The fuel-fired heating appliance of claim 3, wherein the diffuser plate further comprises a third portion that comprises at least some of the first plurality of apertures or at least some of the second plurality of apertures.

7. A combustion apparatus for use in a fuel-fired heating apparatus, the combustion apparatus comprising:

a housing defining an interior and having an inlet configured to receive a fuel/air mixture;

an ignition device configured to ignite, thereby causing the fuel/air mixture entering the interior of the housing to combust to form hot combustion gas;

a first heat exchanger tube and a second heat exchanger tube, each of the first and second heat exchanger tubes having an inlet configured to receive the hot combustion gas from the interior of the housing; and a diffuser plate located upstream of the first and second heat exchanger tubes, the diffuser plate comprising:

a first portion configured to generally align with the inlet of the first heat exchanger tube, the first portion having a first flow area comprising first apertures, each of the first apertures having a first diameter; and a second portion configured to generally align with the inlet of the second heat exchanger tube, the second portion having a second flow area comprising the first apertures and second apertures, each of the second apertures having a second diameter that is greater than the first diameter, wherein the second flow area is greater than the first flow area, and wherein, when the diffuser plate is installed, the first portion is configured to decrease a first flow of the hot combustion gas through the first heat exchanger tube and the second portion is configured to increase a second flow of the hot combustion gas through the second heat exchanger tube in comparison to the first flow and the second flow when the diffuser plate is not installed.

8. The combustion apparatus of claim 7, wherein the fuel-fired heating apparatus is an air heating furnace.

9. The combustion apparatus of claim 7, wherein at least some of the first apertures or at least some of the second apertures are non-uniformly spaced.

10. The combustion apparatus of claim 7, wherein the diffuser plate comprises a number of the first apertures that is greater than a number of the second apertures.

11. The combustion apparatus of claim 7, wherein the diffuser plate further comprises a third portion that comprises the first apertures or the second apertures.

* * * * *